United States Patent [19]

Barca et al.

[11] Patent Number: 4,981,086

[45] Date of Patent: Jan. 1, 1991

[54] PORTABLE AEROSOL SAFETY SHIELD

[75] Inventors: Robert Barca, Huntington; Roland Stewart, Flushing; Richard Wallace, Huntington, all of N.Y.

[73] Assignee: Asol, Inc., Huntington, N.Y.

[21] Appl. No.: 352,218

[22] Filed: May 15, 1989

[51] Int. Cl.[5] ..... E06B 9/00

[52] U.S. Cl. ..... 109/49.5; D24/29

[58] Field of Search ..... 109/9, 10, 24, 49.5; D15/138; D24/29; 312/329; 51/271, 272, 274; 160/10, 127, 351; 98/115.1, 115.2, 115.4

[56] References Cited

U.S. PATENT DOCUMENTS

| | | | |
|---|---|---|---|
| D. 264,722 | 6/1982 | Summers et al. | D15/138 |
| D. 274,466 | 6/1984 | Conlon | D24/29 |
| D. 297,765 | 9/1988 | Conlon | D24/29 |
| D. 297,766 | 9/1988 | Conlon | D24/29 |
| 1,217,838 | 2/1917 | Schmidt . | |
| 2,399,707 | 5/1946 | Salvatore | 90/11 |
| 2,825,268 | 3/1958 | De Mambro et al. | 90/11 |
| 3,127,855 | 4/1964 | Conlon | 109/49.5 |
| 3,183,629 | 5/1965 | Ver Meulen | 51/135 |
| 4,028,476 | 6/1977 | Kleinschmidt et al. | 428/220 |
| 4,059,903 | 11/1977 | Piet | 98/115.3 |
| 4,079,161 | 3/1978 | Kile | 428/220 |
| 4,423,568 | 1/1984 | Gould | D15/138 |
| 4,543,021 | 9/1985 | Adler | 409/134 |
| 4,561,903 | 12/1905 | Bleul | 98/115.3 |

FOREIGN PATENT DOCUMENTS

| | | | |
|---|---|---|---|
| 2109921 | 6/1983 | United Kingdom | 98/115.3 |

OTHER PUBLICATIONS

AK TM Protective Shield-3 Sheets-Submitted by Applicant-filed Jul. 11, 1989.

*Primary Examiner*—Robert L. Wolfe

*Attorney, Agent, or Firm*—Pennie & Edmonds

[57] ABSTRACT

A method for preventing inhalation or ingestion of airborne aerosol particles of toxic or life-threatening materials by medical laboratory personnel wherein a portable safety shield is placed between the body of the laboratory personnel and a container of toxic or life-threatening material prior to opening. The container is opened behind the shield so that any airborne aerosols of the material cannot directly be inhaled or ingested by the laboratory personnel. The safety shield is an upright self-supporting body of a rigid transparent sheet material which comprises a horizontal base, wherein the body is inclined with respect to the base. Notches are provided in the body to facilitate access to the base.

21 Claims, 2 Drawing Sheets

PORTABLE AEROSOL SAFETY SHIELD

TECHNICAL FIELD

This invention relates to a method and apparatus for protecting medical laboratory personnel from toxic or life-threatening materials and more particularly to a method and safety shield for preventing inhalation or ingestion of airborne aerosol particles of toxic or life-threatening materials by medical laboratory personnel.

BACKGROUND ART

When handling blood or biological fluids, medical laboratory personnel or technicians are constantly threatened with exposure to toxic or life-threatening particles. This danger is especially high when these fluids are preserved in vacuum tubes, as is usually the case with blood samples. When opening vacuum tubes, the technician must exercise extreme caution since the sudden onrush of air into the vacuum displaces infinitesimal amounts of fluid thereby propelling invisible fluid particles into the air. The subsequent inhalation or ingestion of these particles or aerosols places the technician in peril of contracting contagious diseases such as hepatitis and AIDS.

Various apparatus have been used to reduce the risk of exposure, such as surgical masks. Such masks, however, have proved to be costly and inadequate since they are uncomfortable to wear and require placement by the technician. Vacuum hoods are similarly undesirable since their size and weight render them unmovable. A technician must therefore interrupt his work in one area of the laboratory to seek the nearest vacuum hood before opening a container or handling toxic or life-threatening materials. These hoods are also expensive to purchase and costly to operate.

Several eye and face guards have been developed primarily for use with routers, drills and other such machinery. Typical examples of such guards can be found in U.S. Pat. Nos. 1,217,838 (eye shield for lathes and grinding wheels); 2,399,707 (face guard for routers); 2,825,268 (eye and body shield for metal cutting machines); 3,183,629 (splash curtain for belt grinder); and 4,423,568 (splash guard for glass router). These guards are typically designed to protect the machine operator from flying metal particles and are usually equipped with means for attaching the apparatus to the machine.

U.S. Pat. No. 3,127,855 relates to a laboratory apparatus shield which has two finger holes at its uppermost edge for transporting the shield. The existence of the holes renders this shield ineffective for the method disclosed herein because aerosols may easily escape through these holes to endanger the technician.

None of these guards or shields is capable, however, of preventing inhalation and ingestion of airborne aerosol particles of toxic or life-threatening materials by medical laboratory personnel.

SUMMARY OF THE INVENTION

The present invention relates to a method and apparatus for protecting medical laboratory personnel from airborne aerosol particles of toxic or life-threatening materials. The invention will prevent laboratory personnel from inhaling or ingesting the harmful aerosol particles which are expelled into their breathing space upon opening containers of toxic or life-threatening materials, especially those which are vacuum pressurized.

The invention may be used in all areas where blood or biological fluids are handled or analyzed, for example hematology labs during slide preparation or during instrument operation when opening samples for processing; in chemical labs when preparing samples after spinning of blood or for pouring off samples for process in an instrument; in blood banks during and after spinning of all blood samples; in microbiology labs when opening urine containers and inoculating blood plates; and in central separation where samples are received and channelled off to the appropriate lab for testing.

Medical laboratory personnel will be protected by a shield which is placed between the body of the laboratory personnel and the container of toxic or life-threatening materials prior to opening. The shield creates an immediate safety zone by controlling the flight of any material expelled from the container upon its opening. Subsequent to each use, the shield can easily be cleaned, for example, with a solution of bleach which kills all bacteria and viral organisms, including the AIDS virus. The base may be covered with a disposable adsorbent material to facilitate cleaning thereof.

The shield of the invention comprises an upright self-supporting body having a horizontal base and an upwardly projecting surface. Besides functioning as a structural member, the horizontal base may also be used as a working surface. The upwardly projecting surface may take on a variety of shapes, sizes and orientations but is preferably a planar surface forming an angle with respect to the horizontal base. This surface also includes means to facilitate access to the horizontal base so that laboratory personnel can obtain protection from the shield while handling, processing or analyzing toxic or life-threatening on the base. These access means may be any suitable cutout or recess which is sufficiently large to allows a technician to position his hands into the region of the base behind the planar surface.

The shield of this invention is preferably made from a transparent, shatter resistant and lightweight material so that the apparatus may readily be carried from station to station within the laboratory. The shield should be sufficiently thick to ensure protection from heat and to provide structural rigidity.

In an alternate embodiment, the shield comprises a horizontal base and a planar surface attached to the base along one edge by a hinge. In this configuration, the angle between the planar surface and the horizontal base can be varied according to the task at hand or the taste of the individual user. This embodiment also allows for easier shipping and storage of the device.

BRIEF DESCRIPTION OF THE DRAWINGS

The nature, advantages, and various other additional features of the invention will appear more fully upon consideration of the illustrative embodiments now to be described in detail in connection with the accompanying drawing figures, wherein.

DETAILED DESCRIPTION OF THE PREFERRED EMBODIMENTS

Figure 1:
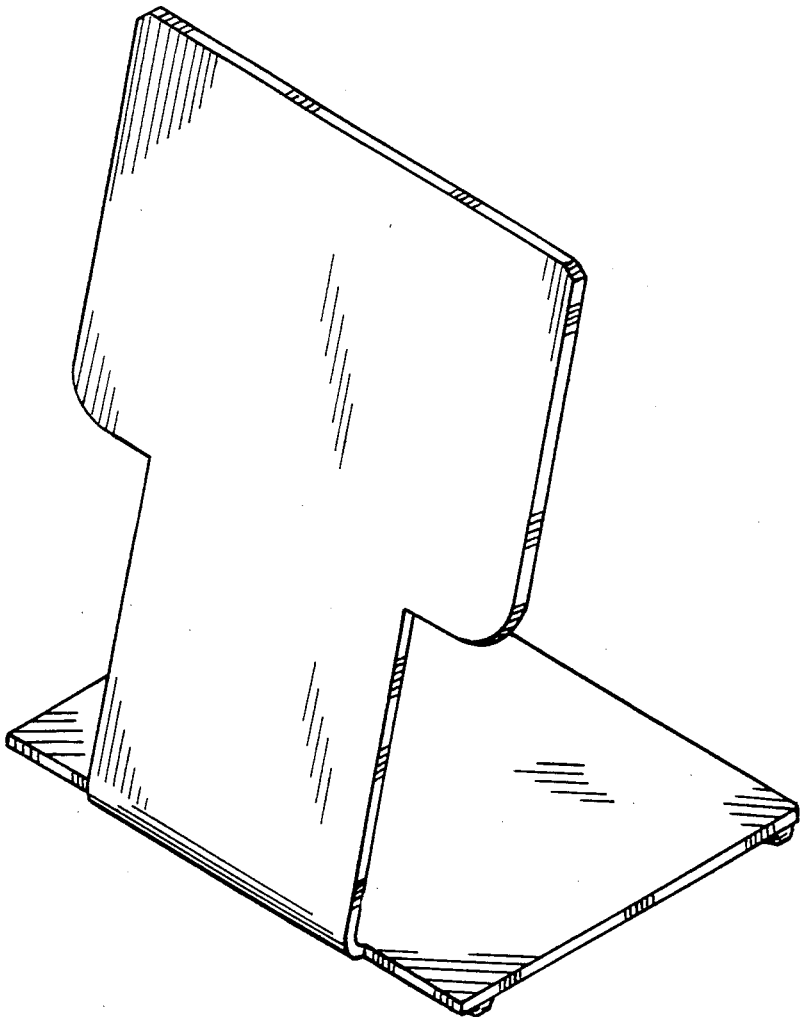
FIG. 1 is a perspective view of the aerosol safety shield according to the invention.
Figure 2:
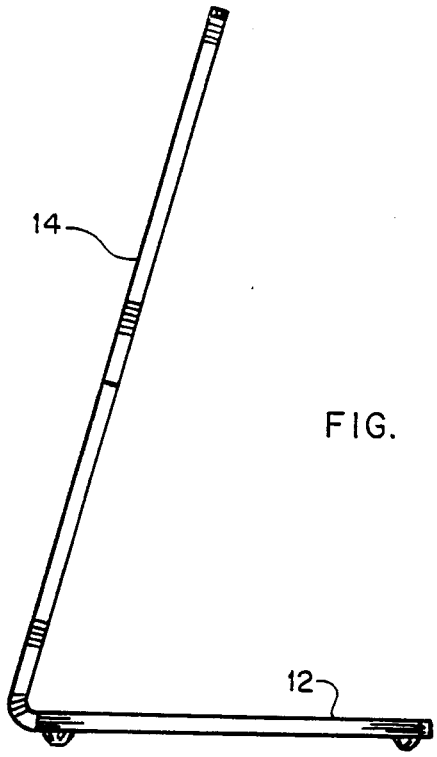
FIG. 2 is a side view of the shield of FIG. 1.
Figure 3:
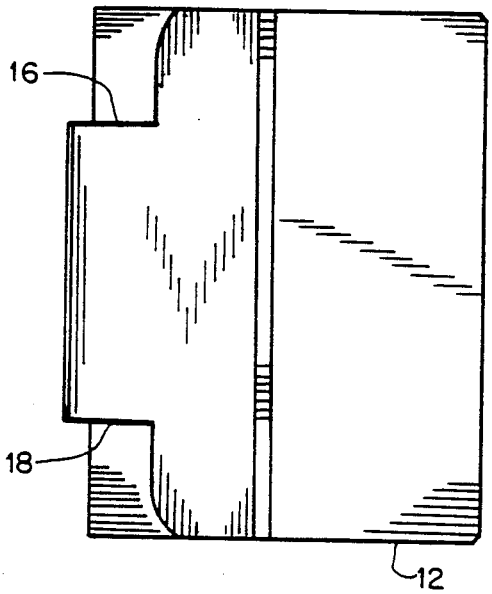
FIG. 3 is a plan view of the shield of FIG. 1.

In the preferred embodiment, an aerosol safety shield as shown in FIGS. 1, 2 and 3 is used in a medical laboratory to protect laboratory personnel from the adverse affects of toxic or life-threatening aerosol which may be expelled into the air during the course of their normal lab work.

A safety shield generally designated by the numeral 10, comprises a horizontal base 12, an upwardly projecting planar surface 14 and access means 16 and 18. Horizontal base 12 is substantially rectangular and has upper and lower surfaces. The lower surface of base 12 is equipped with support members, e.g., rubber legs, to absorb the shock of any impacts to which the shield may be subject and to prevent shield 10 from unnecessary slippage. The upper surface of base 12 is ideally suited for use as a working area.

Planar surface 14 projects upward from base 12 at a 60° angle to provide a protective surface between the laboratory personnel and the blood sample being processed or analyzed. The angled configuration also provides the proper distribution of weight to ensure the stability and balance of shield 10.

Along each side, planar surface 14 is equipped with access means 16 and 18 which extend from base 12 upward to about midway up its height. Access means 16 and 18 are notches whose open ends are directed outwardly, so that laboratory personnel can gain access to base 12 while maintaining the safety of the shield.

Prior to handling any toxic or life-threatening material, the laboratory technician places shield 10 on any convenient flat surface with planar surface 14 angling away from the technician. The container of material is then placed on base 12 behind planar surface 14. The shield provides notches 16 and 18 which conveniently allow access for the arms of a technician to the base for easy handling of the blood sample. The shield may be cleaned with a solution of bleach after use. Thus, the technician can process or analyze the material in total safety.

While it is apparent that the invention herein disclosed is well calculated to fulfill the objects above stated, it will be appreciated that numerous embodiments and modifications may be devised by those skilled in the art, and it is intended that the appended claims cover all such modifications and embodiments as fall within the true spirit and scope of the present invention.

What is claimed is:

1. A method for preventing inhalation or ingestion of airborne blood aerosol particles of toxic or life-threatening materials by medical laboratory personnel which comprises:

placing a freestanding portable safety shield between the body of said medical laboratory personnel and a container of said toxic or life-threatening materials, said shield comprising an upright self-supporting body of a rigid sheet material having a horizontal base, said body inclined with respect to said base and having side portions which include means to facilitate access to said base; and opening said container behind said shield; where the generation of airborne blood aerosols of said materials by said container opening cannot be directly ingested or inhaled by said personnel.

2. The method of claim 1 wherein the portable safety shield comprises an upright self-supporting body of a rigid transparent sheet material having a horizontal base and an inclined planar surface extending upward from said base, said surface having an inner face and an outer face.

3. The method of claim 2 wherein the portable safety shield further comprises means to facilitate access to said base by said personnel from said outer face.

4. The method according to claim 3 wherein said access facilitating means comprises a pair of notches on either side of said inclined planar surface.

5. The method of claim 3 wherein said notches extend from said base to about midway up said inclined surface.

6. The method of claim 2 wherein the portable safety shield further comprises means to support said body in a manner to resist sliding movement thereof.

7. The method of claim 6 wherein said support means comprise a plurality of rubber members attached to and spaced in a pattern on the underside of said base.

8. The method according to claim 2 wherein said sheet material is acrylic.

9. The method according to claim 2 wherein the angle between said base and said inclined surface is 60 degrees.

10. The method of claim 1 wherein said shield is cleaned with a solution of bleach after each use.

11. The method of claim 1 wherein said base is covered by a disposable, absorbent material to facilitate cleaning thereof.

12. The method of claim 1 wherein the portable safety shield comprises a horizontal base which is substantially rectangular and a planar surface hingedly mounted to said base along one edge thereof, said surface having a pair of notches on either side to provide access to said base.

13. The method of claim 12 wherein said base further comprises means to support said shield in a manner to resist sliding movement thereof.

14. The method of claim 13 wherein said support means comprise a rubber member located in each corner of the underside of said rectangular base.

15. A method for preventing inhalation or ingestion of airborne blood aerosol particles of toxic or life-threatening materials by medical laboratory personnel which comprises:

placing a freestanding portable safety shield between the body of said medical laboratory personnel and a container of said toxic or life-threatening materials, said shield comprising an upright self-supporting body of a rigid transparent sheet material having a horizontal base and an inclined planar surface extending upward from said base, wherein said inclined planar surface further comprises inner and outer faces and a pair of notches which extend from said base to about midway up said inclined surface on either side thereof for facilitating access to said base from said outer face and wherein said base further comprises means to support said body in a manner to resist sliding movement thereof; and opening said container behind said shield; where the generation of airborne blood aerosols of said materials by said container opening cannot be directly ingested or inhaled by said personnel.

16. The method according to claim 15 wherein said sheet material is acrylic and said support means comprise a plurality of rubber members attached to and spaced in a pattern on the underside of said base.

17. The method according to claim 15 wherein the angle between said base and said inclined surface is 60 degrees.

18. The method of claim 15 wherein said shield is cleaned with a solution of bleach after each use.

19. The method of claim 15 wherein said base is covered by a disposable, absorbent material to facilitate cleaning thereof.

20. A method for preventing inhalation or ingestion of airborne aerosol particles of toxic or life-threatening materials by medical laboratory personnel which comprises:

placing a freestanding portable safety shield between the body of said medical laboratory personnel and a container of said toxic or life-threatening materials, said shield comprising a horizontal base which is substantially rectangular and a planar surface hingedly mounted to said base along one edge thereof, said surface having a pair of notches on either side to provide access to said base, wherein said rectangular base is provided with a rubber leg in each corner to support said shield in a manner to resist sliding movement thereof; and opening said container behind said shield; where the generation of airborne blood aerosols of said materials by said container opening cannot be directly ingested or inhaled by said personnel.

21. A method for preventing inhalation or ingestion of airborne blood aerosols from blood which contains toxic or life-threatening materials by medical laboratory personnel which consists essentially of:

placing a free standing, portable safety shield between the body of said medical laboratory personnel and a container of said blood, said shield comprising an upright self-supporting body of a rigid sheet material having a horizontal base, said body inclined with respect to said base and having side portions which include means to facilitate access to said base; and opening said container behind said shield; where the generation of airborne blood aerosols by said container opening cannot be directly ingested or inhaled by said personnel.

* * * * *